US005918736A

United States Patent [19]

Suzuki et al.

[11] Patent Number: 5,918,736

[45] Date of Patent: Jul. 6, 1999

[54] CIGARETTE PACKAGE WITH EXTINGUISHING CAPS

[76] Inventors: Shougo Suzuki; Yasuchika Sogabe, both of 5-13-22 Toyozumi, Kashiwa-City, Chiba-pref., Japan, 277

[21] Appl. No.: 08/991,367

[22] Filed: Dec. 16, 1997

[51] Int. Cl.[6] ..... B65D 85/10; A24F 15/18; A24F 13/18

[52] U.S. Cl. ..... 206/246; 131/235.1; 131/256

[58] Field of Search ..... 206/86, 242, 246; 131/235.1, 256

[56] References Cited

U.S. PATENT DOCUMENTS

| | | | |
|---|---|---|---|
| 2,101,593 | 12/1937 | Osborn | 131/256 |
| 2,233,324 | 2/1941 | Palmer | 131/235.1 |
| 2,371,445 | 3/1945 | Irvin | 131/256 |
| 2,418,188 | 4/1947 | Nixon, Jr. | 131/235.1 X |
| 2,606,562 | 8/1952 | Siegel | 206/246 X |
| 2,741,109 | 4/1956 | Dupuis | 206/246 X |
| 2,764,984 | 10/1956 | Cohen et al. | 131/256 X |
| 2,843,134 | 7/1958 | L'Bass | 206/246 X |
| 5,368,155 | 11/1994 | Ewen | 206/246 X |

FOREIGN PATENT DOCUMENTS

| | | | |
|---|---|---|---|
| 406046822 | 2/1994 | Japan | 206/246 |
| 406070740 | 3/1994 | Japan | 206/246 |

*Primary Examiner*—Bryon P. Gehman

[57] ABSTRACT

A cigarette packet includes a closable compartment for housing fresh cigarettes and a closable housing within the package containing a plurality of fire-extinguishing members. These members are positioned within the housing and are attached to the package. Each of these members is made from a flame resistant and fire-extinguishing material and has a shape in which a burning end of a cigarette butt may be inserted to extinguish the butt. In one preferred embodiment of the invention, the members are removable caps housed in the lid of the flip-top type lid of the package with the caps adhering to and sealing the end of the cigarette when extinguished thereagainst.

18 Claims, 13 Drawing Sheets

CIGARETTE PACKAGE WITH EXTINGUISHING CAPS

BACKGROUND OF THE INVENTION

The present invention pertains to a cigarette package and, more particularly, to a cigarette package having individual compartments for holding fresh cigarettes, a cigarette coal extinguisher, and a receptacle for discarded cigarette butts.

In the absence of accessible ashtrays, smokers often find themselves with no other alternative to disposing of cigarette ashes and butts by littering. Portable ashtrays offer little help as they have insufficient capacity to hold all the ash left by a package of cigarettes. On the other hand, ashtrays that have adequate capacity are not easily portable. Thus, the smoker is presented with the dilemma of having to decide whether or not to carry a separate ashtray. There are those in the prior art who have attempted to address these problems with various types of cigarette packages, cigarette extinguishers, and extinguisher-equipped cigarettes, as described in Japanese patents Showa-60-168374, Heisel-4-279446, Heisel-4-58877, Heisel-4-252169, and Heisel-6-46822.

Other than the Japan Patent Heisel-6-46822, noted above, those involved in the design of previous cigarette packages apparently did not consider the problem of what to do with cigarette butts. Properly disposing of cigarette butts presents socioenvironmental problems to the smoker, as those with no access to ashtrays found themselves having to litter. The wrapped cigarette container component or package of Japan Patent Heisel-6-46822 comprises a cigarette storage part and an extinguisher part. The storage part contains latticework-type chambers, each sized to hold one cigarette. The extinguisher part comprises an extinguisher compartment located adjacent to the storage compartment. The extinguisher compartment contains an extinguisher cylinder, which has a tapered end, and is firmly attached to it. When the smoker wishes to smoke, he or she retrieves a cigarette from the wrapped container compartment. After finishing the cigarette, the smoker inserts the still-smoldering butt into the extinguisher cylinder. Being deprived of oxygen by the tapered end of the extinguisher, the burning ember of the cigarette butt is extinguished. Afterward, when the smoker again wishes to smoke, the butt is retrieved from extinguisher cylinder and placed into the original storage compartment for the cigarette and a new cigarette may be selected from the package. Upon consuming the new cigarette, the butt is placed as before in the extinguisher cylinder.

The extinguisher of Japan patent Heisel-6-46822 was designed specifically and solely to extinguish cigarettes. After a cigarette had been extinguished, it would be removed from the cylinder, and then returned to the compartment from which it had originally been retrieved. Since it was returned to the compartment with its ashy end exposed, the cigarette tended to leave the compartment visibly dirty. Moreover, since many smokers would want to avoid this type of problem, they might well resort to other solutions (e.g., littering) to the problem of cigarette disposal.

An important object of the present invention is to enable the smoker to place an extinguished cigarette butt in its original compartment without dirtying the compartment. Another object of this invention is to free the smoker from the temptation to litter by providing both an ash receptacle and a storage compartment for cigarette butts. Still another important object of the present invention is to relieve people of the burden of having to carry portable ashtrays around with them.

SUMMARY OF THE INVENTION

As a first step toward achieving the objectives described above, the cigarette package of the present invention contains partitions in its compartment for storing fresh and smoked cigarettes. In one embodiment thereof, an extinguisher cap mount is located at the upper or lower part of the package, as is an ash receptacle unit. When the smoker uses this package, he or she opens the lid to the compartment, retrieves a cigarette from inside of it, and lights the cigarette. When the cigarette is finished, the smoker extinguishes its fire by inserting it into a conical extinguishing device (i.e., an extinguisher cap) made of flame-resistant or flame-retardant material (ideally, a substance that shrinks to some degree when heated and has thermosetting properties). If, at such a time, a small amount of absorbent material, such as a superhydrated polymer, is also used for moisture absorption, the result will be an improvement in extinguishing reliability, as well as a shortening of the time required for extinguishing and cooling. After the smoker has confirmed that the cigarette is, in fact, out, he or she then returns it, capped, to the empty compartment whence it was first retrieved. At such a point, previous cigarette storage methods did not allow for the easy return of cigarettes due to the problem of other cigarettes getting in the way. This device addresses this problem by dividing the storage compartment into receptacles, each of which holds a single cigarette. This improvement makes it easy for the smoker to retrieve fresh cigarettes, and storage cigarette butts. In addition, it prevents the odor from the butts from tainting cigarettes that have yet to be smoked.

In addition, the present invention may also provide for the storage of ash in an ash receptacle whose lid is an independent part of the storage compartment. The interior part of this lid coated with flame-resistant or flame-retardant materials. Therefore, even if some fire is accidentally permitted to reach the inside of the ash receptacle, it will not burn. Moreover, closure of the lid prevents oxygen from centering the receptacle, thereby providing yet a further safeguard against fire. After the ash has been stored in this manner, the cigarette butt can be returned to the storage space where it was originally held. Because the extinguisher cap is attached to the extinguished end of the cigarette butt, any remaining ash on the extinguished end of the butt will be prevented from soiling the storage compartment.

DETAILED DESCRIPTION OF THE DRAWINGS

Figure 1:
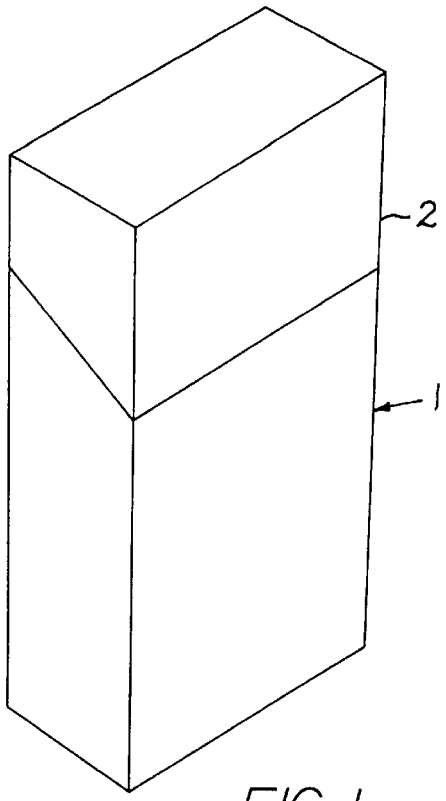
FIG. 1 is a front perspective view of one embodiment of the cigarette package of the present invention, having both a cigarette compartment and extinguisher caps.
Figure 2:
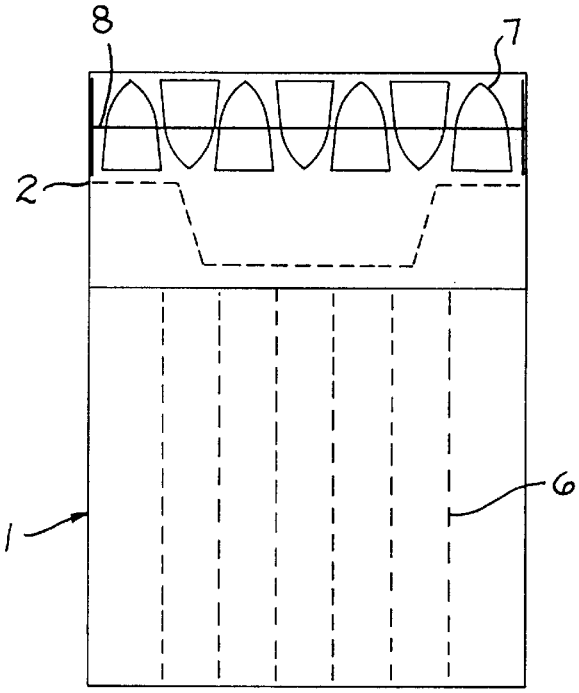
FIG. 2 is front view of the embodiment of FIG. 1, partially in section, illustrating in dashed lines the compartments for the fresh cigarettes and the extinguisher cap built into the lid.
Figure 4:
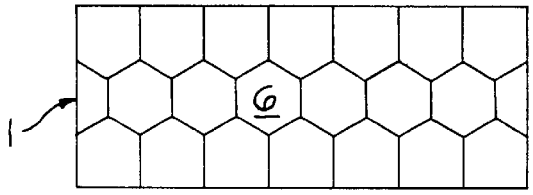
Figure 5:
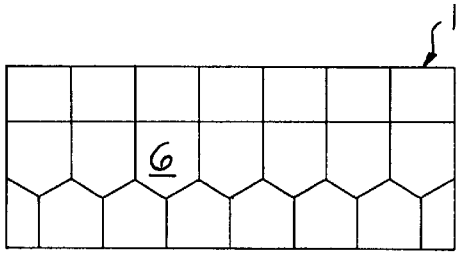
Figure 6:
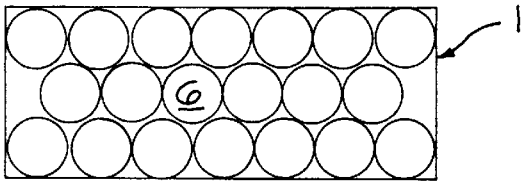
Figure 10:
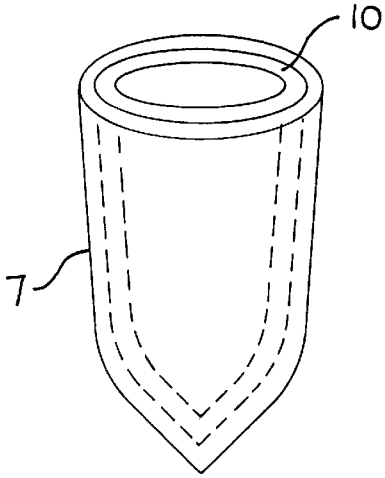
Figure 11:
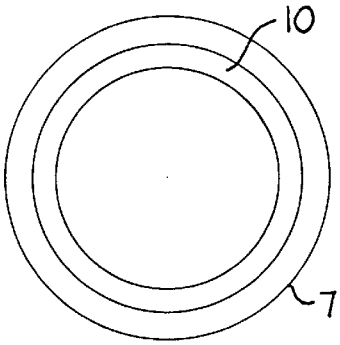
Figure 7:
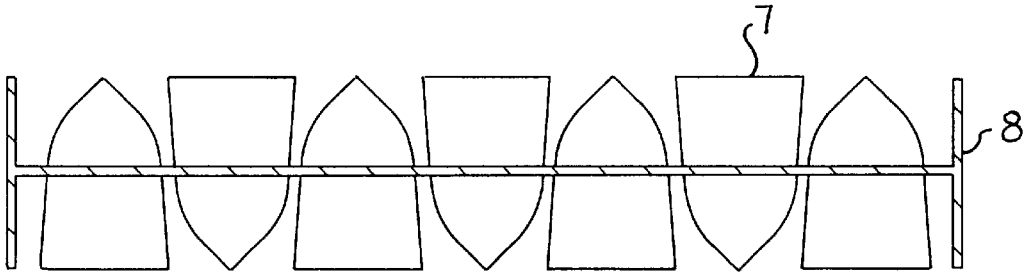
Figure 8:
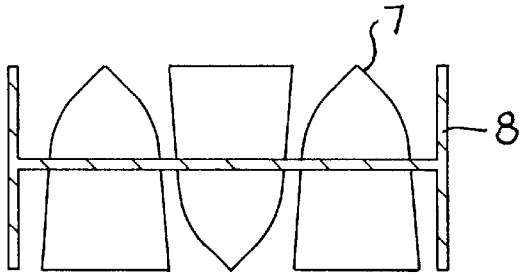
Figure 9:
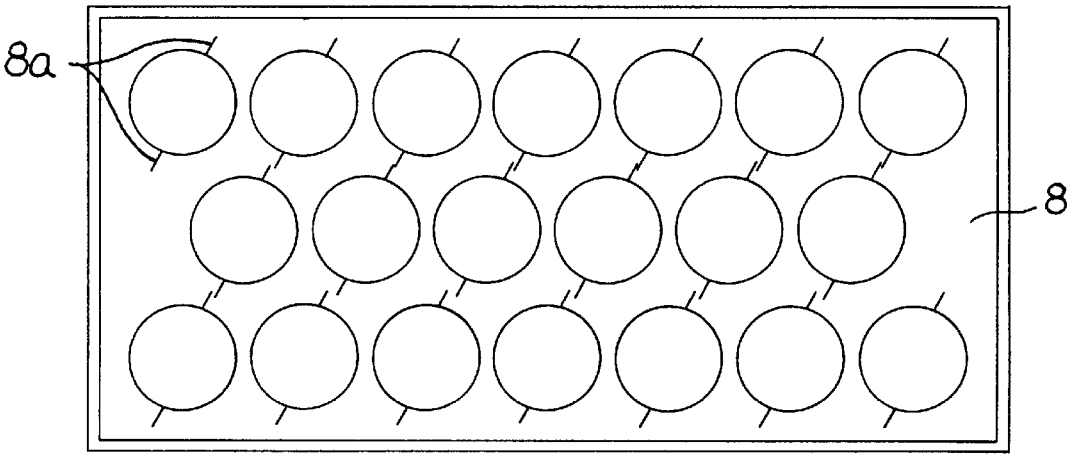
Figure 12:
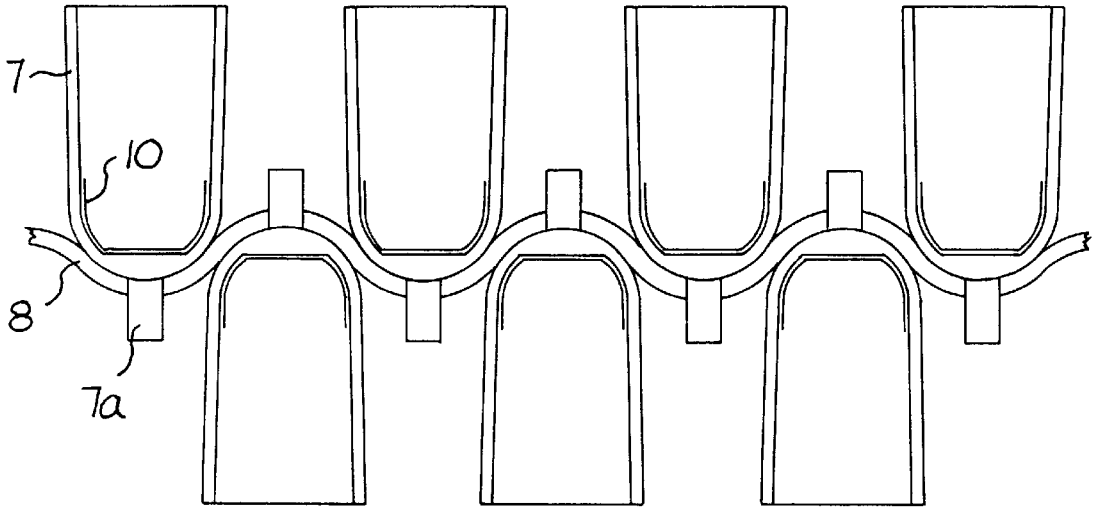
Figure 13:
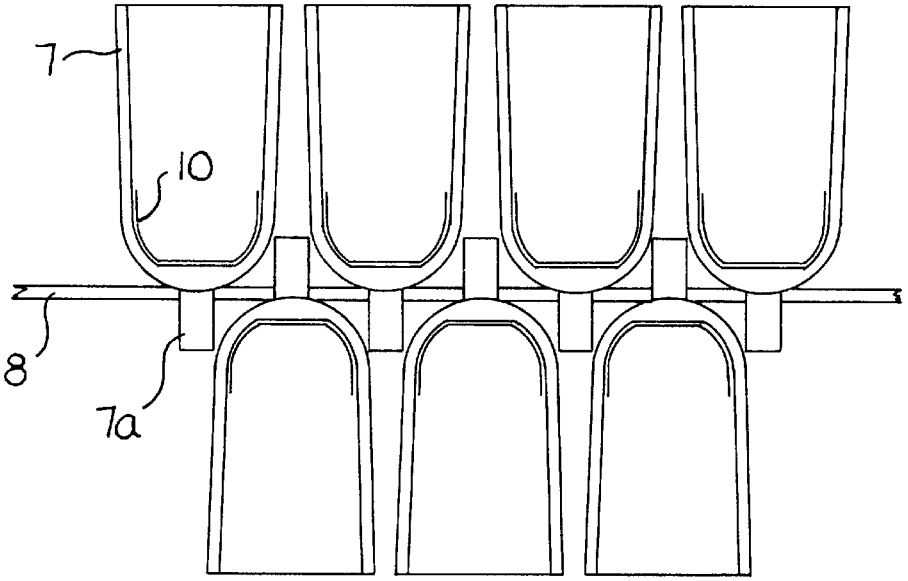
Figure 14:
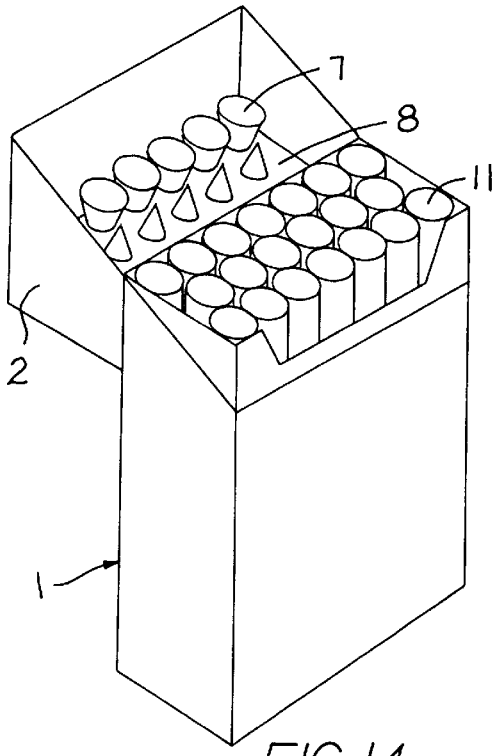
Figure 15:
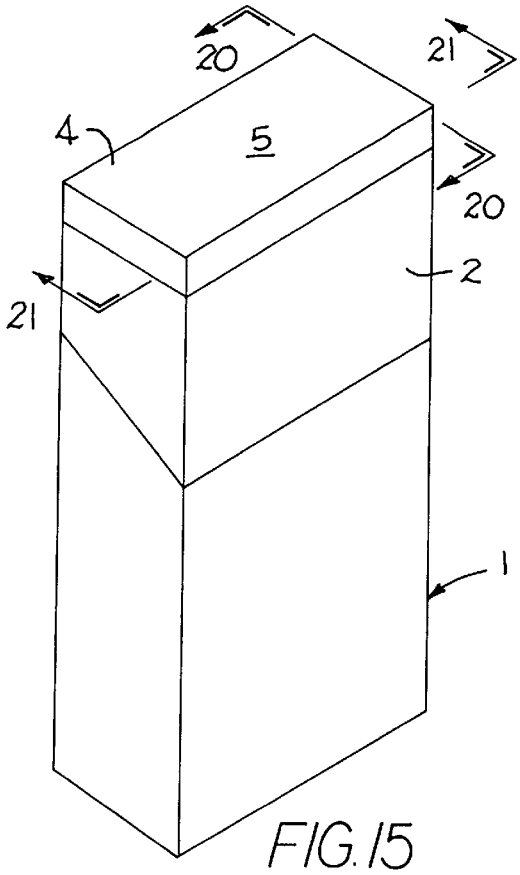
Figure 16:
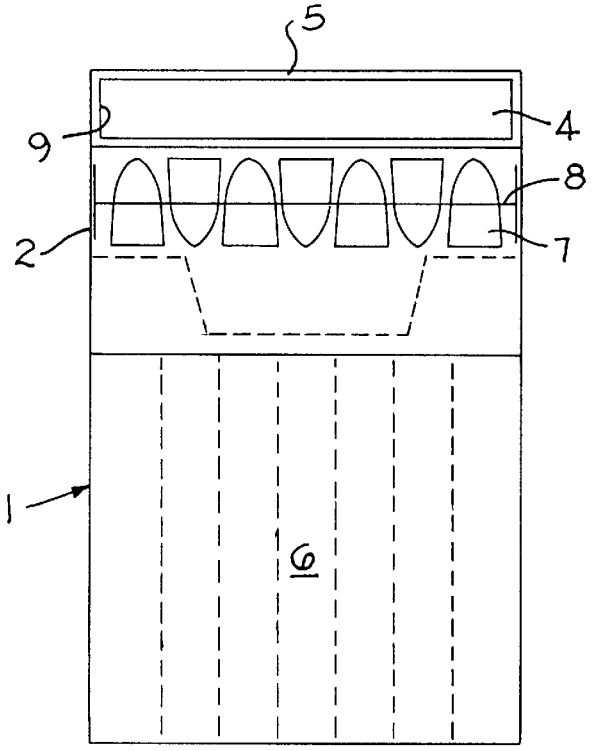
Figure 17:
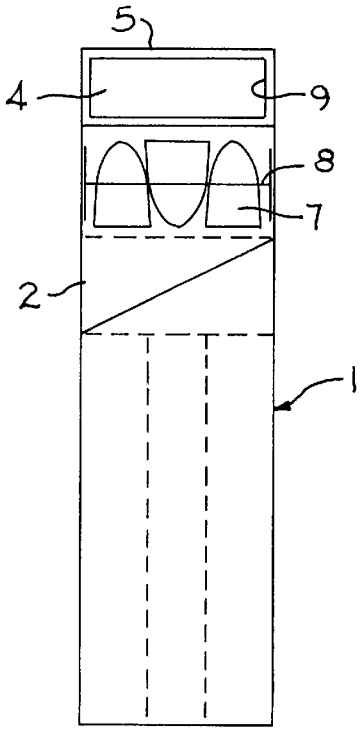
Figure 18:
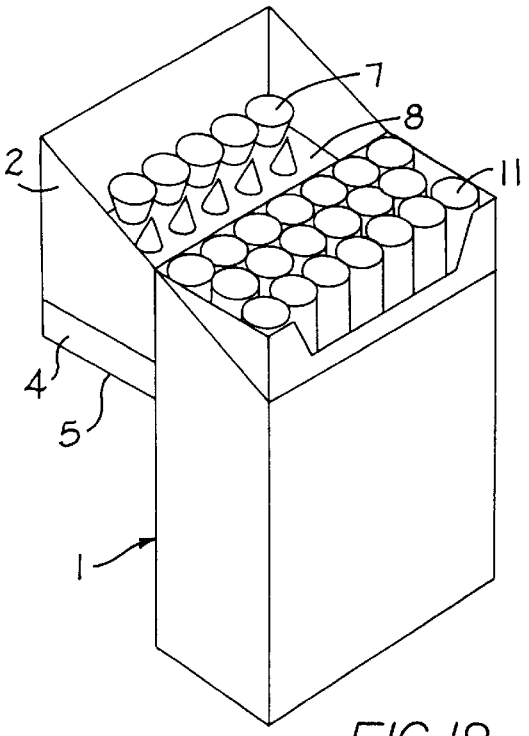
Figure 19:
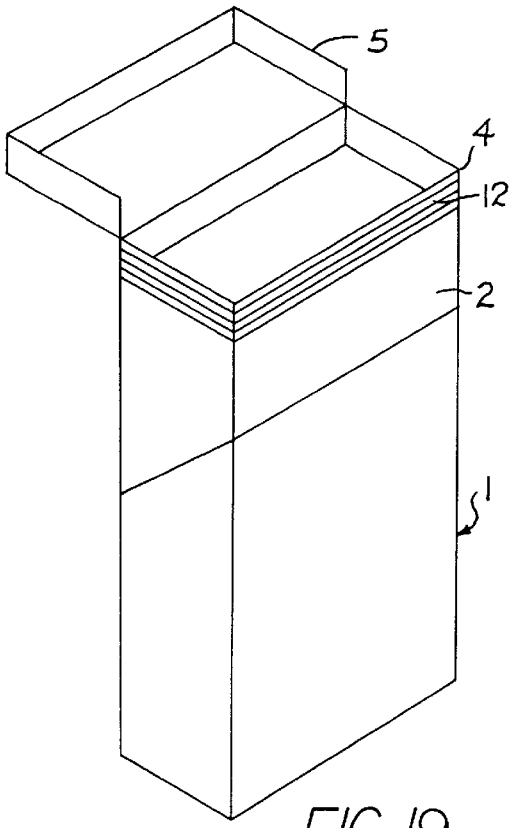
Figure 22:
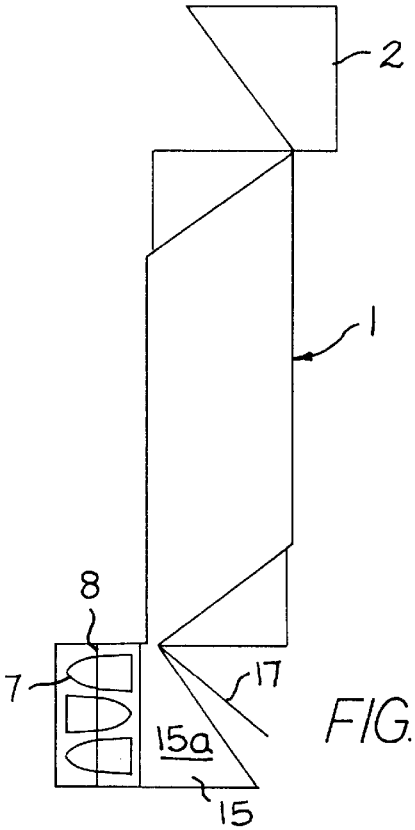
Figure 23:
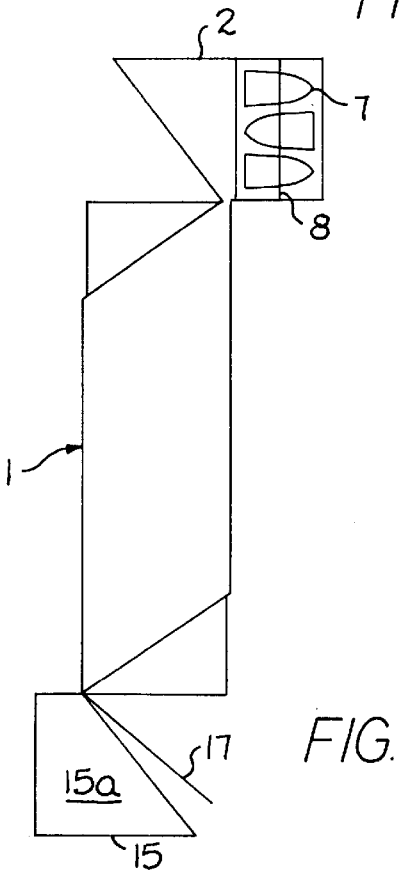
Figure 20:
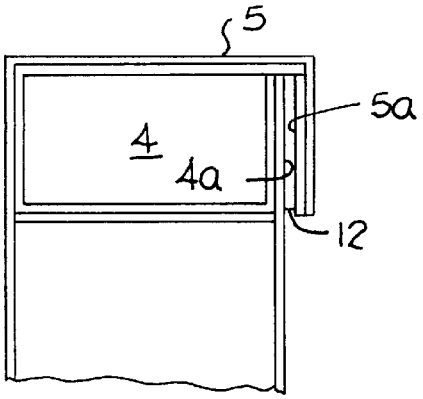
Figure 21:
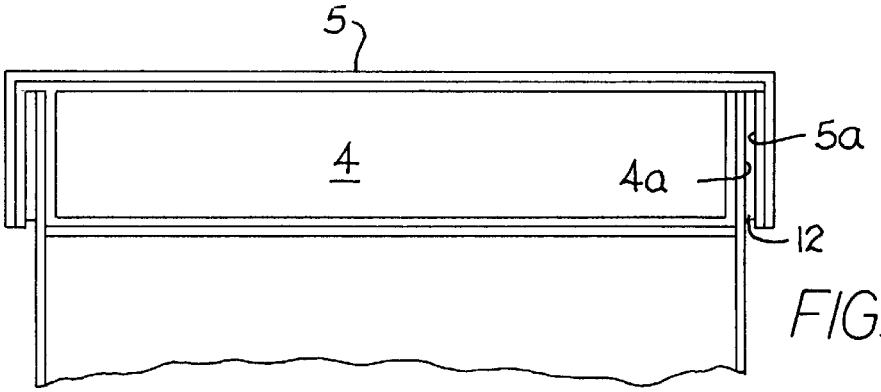
Figure 24:
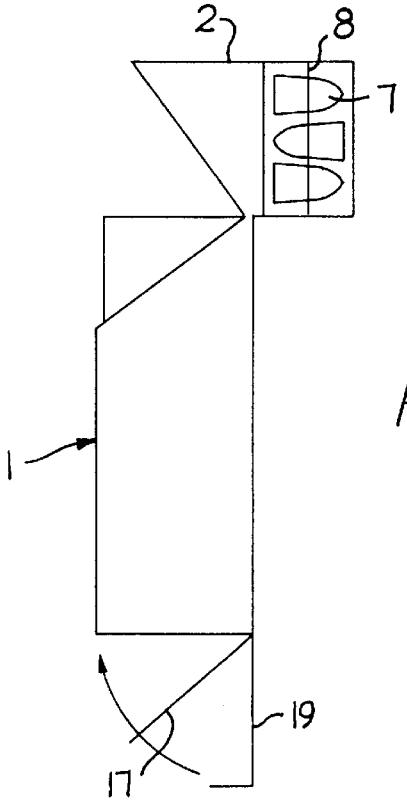
Figure 25:
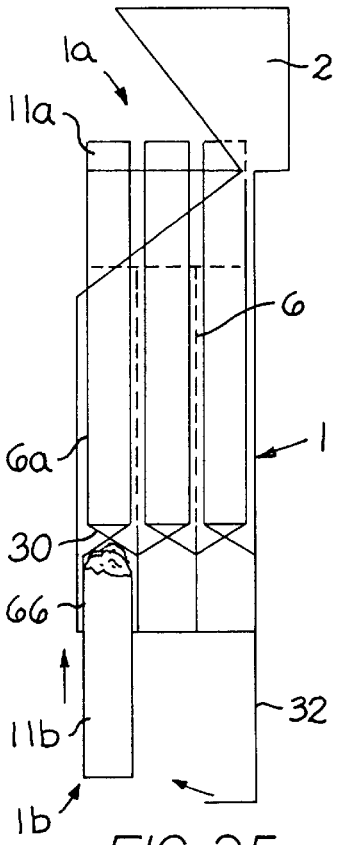
Figure 26:
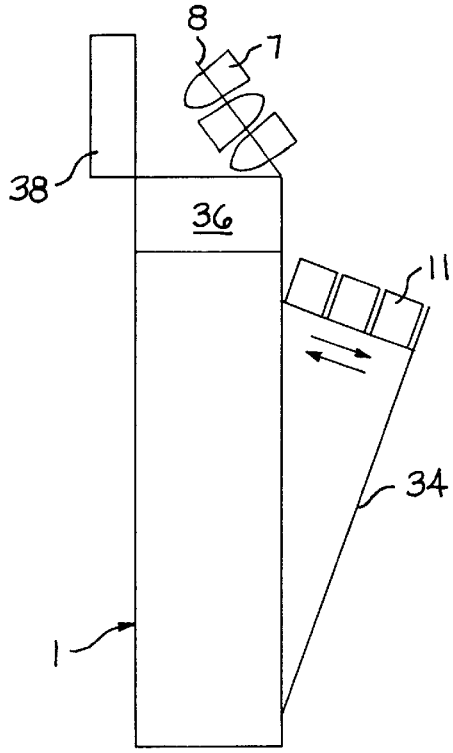
Figure 27:
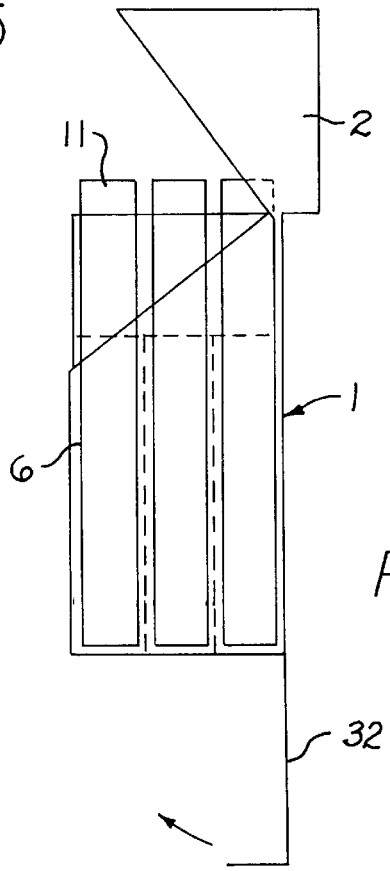
Figure 28:
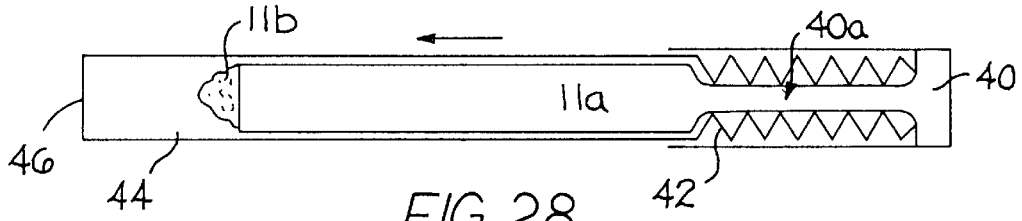
Figure 30:
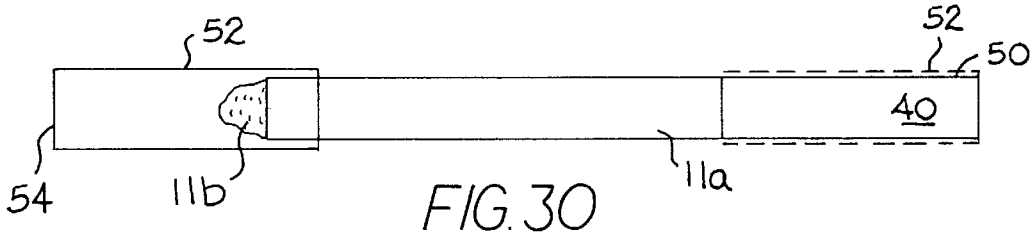
Figure 29:
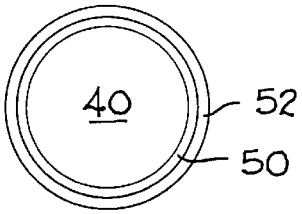
Figure 31:
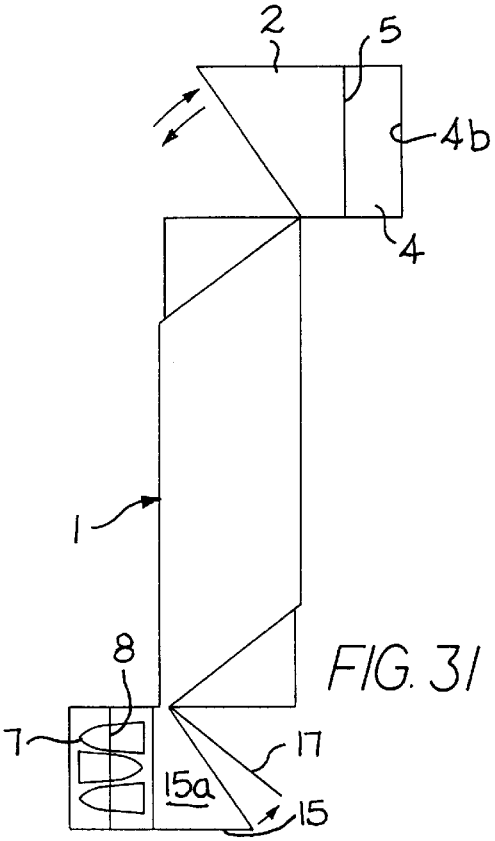
Figure 32:
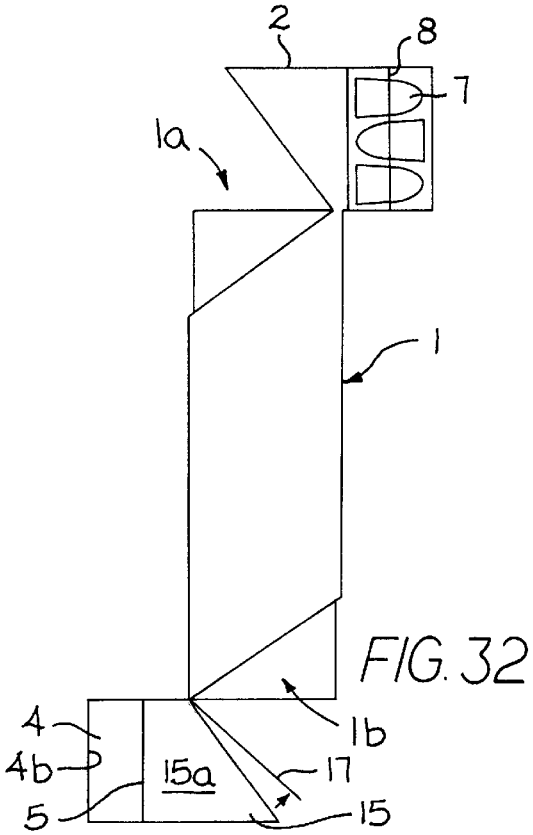
Figure 33:
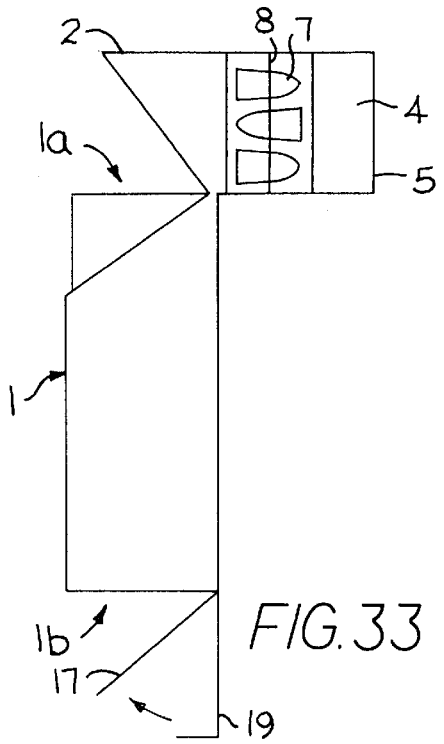
Figure 34:
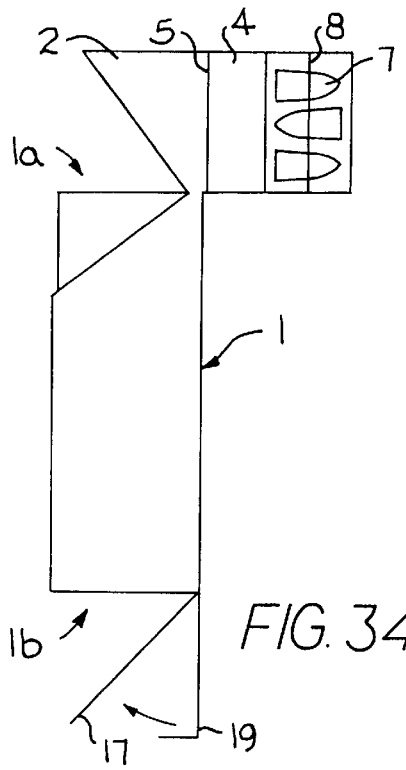
Figure 35:
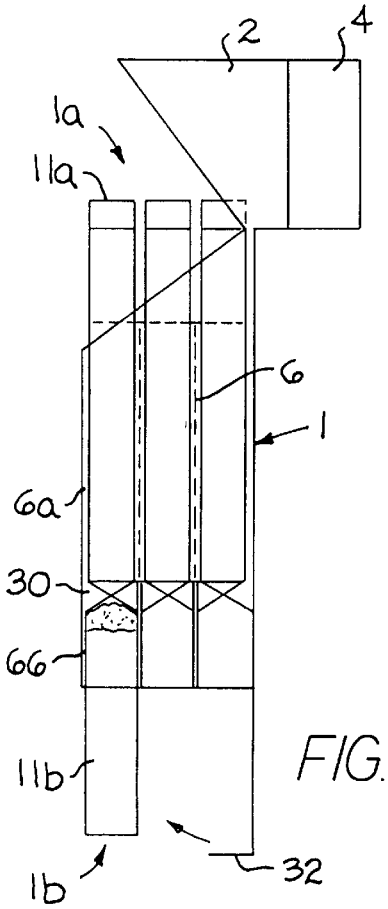
Figure 36:
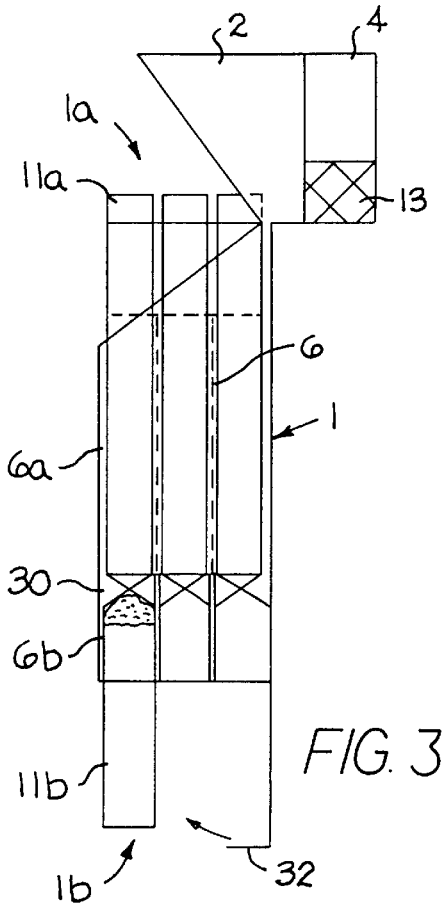
Figure 37:
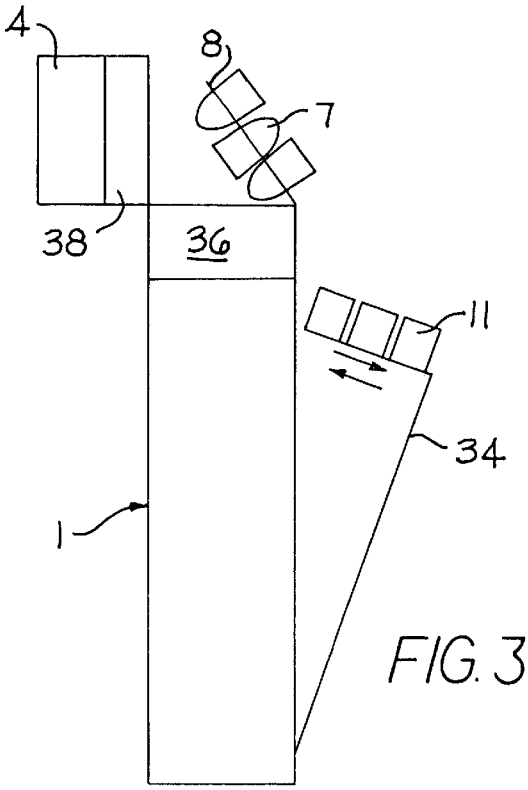
Figure 39:
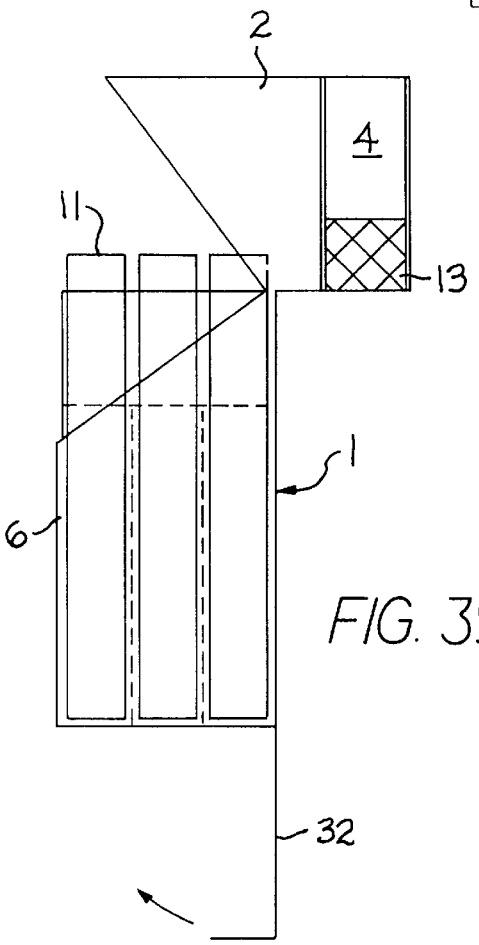
Figure 38:
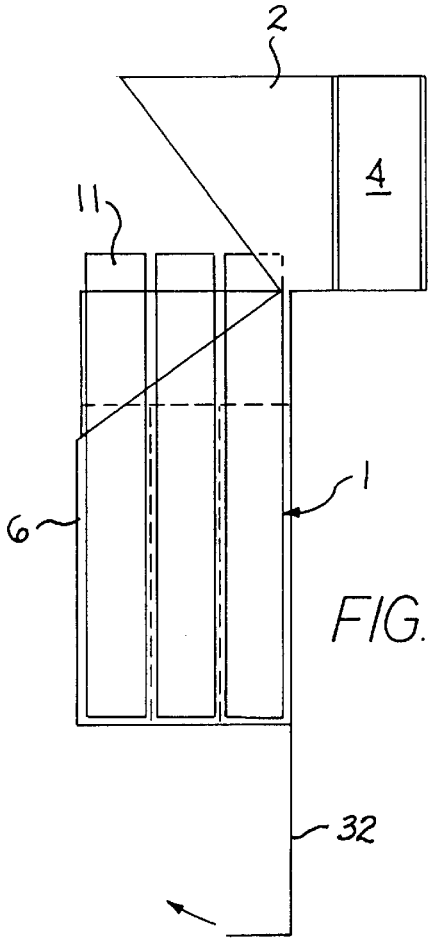
Figure 40:
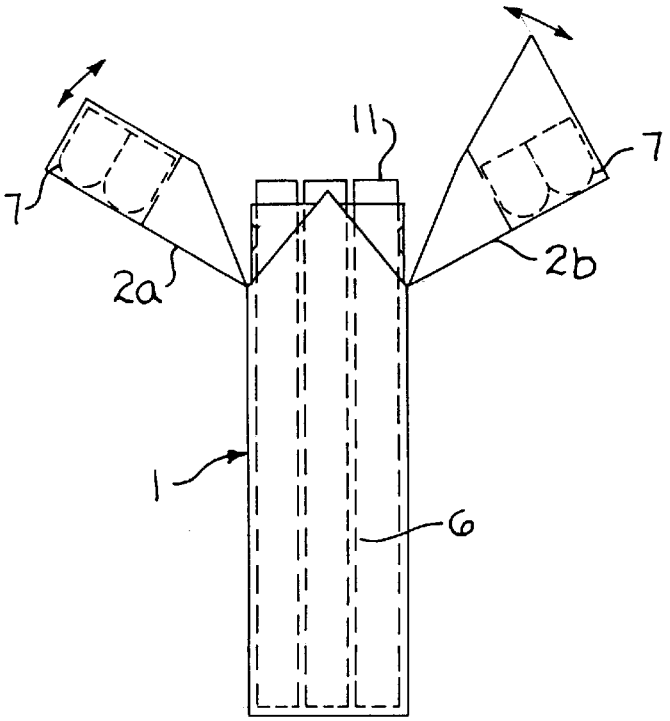
Figure 41:
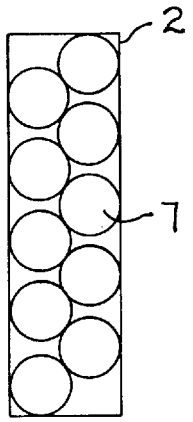
Figure 42:
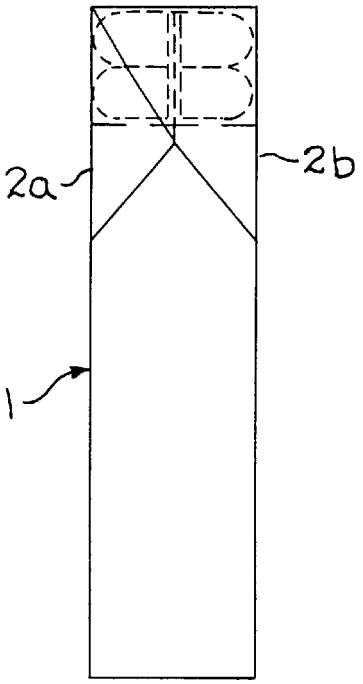
Figure 43:
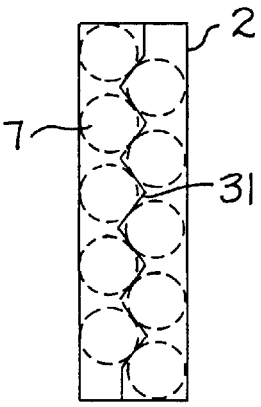
Figure 44:
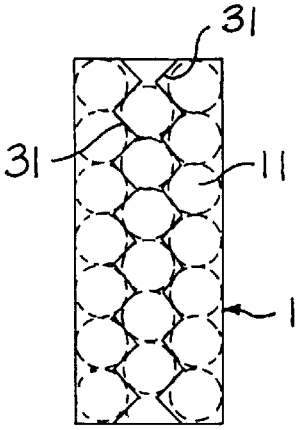
Figure 45:
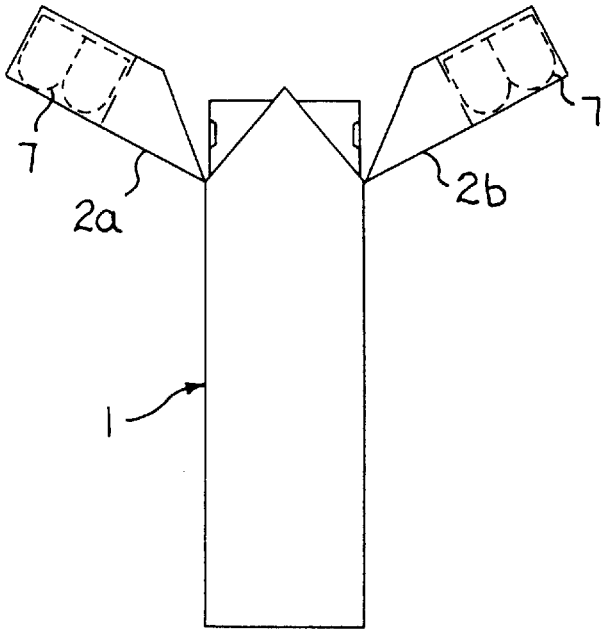
Figure 46:
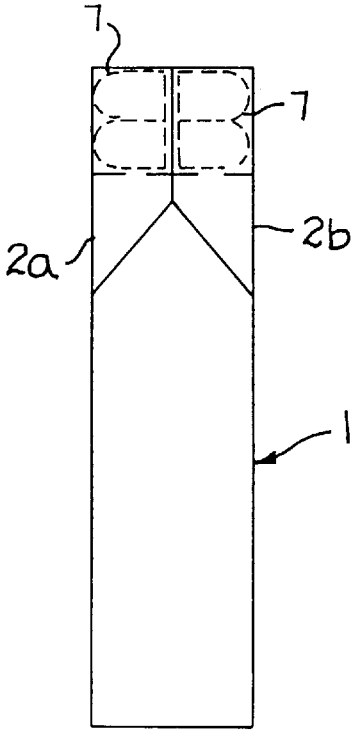

FIG. 4, 5, and 6 are respective planar views a cigarette compartments having a combination of hexagonal and pentagonal sections, a combination of square and pentagonal sections, and circular sections;

FIG. 7 is an enlarged front view of the extinguisher caps of FIG. 2;

FIG. 8 is an enlarged side view of the extinguisher caps of FIG. 2;

FIG. 9 is an enlarged top view of the extinguisher caps of FIG. 2;

FIG. 10 is a perspective view of a single extinguisher cap shown cutaway to depict the layering within the cap;

FIG. 11 is a top view of the extinguisher cap of FIG. 10;

FIG. 12 is a side view of the extinguisher caps of FIG. 2 illustrating a technique of mounting the caps;

FIG. 13 is a side view of the extinguisher caps of FIG. 2 illustrating another mounting technique;

FIG. 14 is a perspective view similar to that shown in FIG. 1 with the lid opened;

FIG. 15 is a perspective view of another embodiment of the present invention, similar to that shown FIG. 1, but with the addition of a cigarette ash receptacle;

FIG. 16 is a front view, partially in section, of the embodiment of FIG. 15;

FIG. 17 is a side view, partially in section, of the embodiment of FIG. 15;

FIG. 18 is a perspective view of the embodiment of FIG. 15 with the lid to the inner compartment containing the fresh cigarettes in an open position and the lid to the ash receptacle in a closed position;

FIG. 19 is a perspective view of the embodiment of FIG. 15 with the lid to the ash receptacle in an open position and the lid to the compartment containing the fresh cigarettes in a closed position;

FIG. 20 is a sectional view of the top of the package taken along lines 20—20 of FIG. 15;

FIG. 21 is a sectional view of the top of the package taken along lines 21—21 of FIG. 15;

FIG. 22 is a side view of yet another embodiment of the present invention, having lids at both the top and bottom of the package for respective retrieval of fresh cigarettes and placement of the butts, wherein the extinguisher caps are located in the lid covering the butt receptacles;

FIG. 23 is a side view of a variation of the FIG. 22 embodiment in which the extinguisher caps are placed in the lid covering the fresh cigarette compartment;

FIG. 24 is a side view of still another variation of the FIG. 22 embodiment in which a flap is used as a lid for the butt receptacle in combination with a partition;

FIG. 25 is a side view of yet another embodiment of the present invention in which the extinguisher caps are in the butt receptacle, and the butts are pushed into the receptacle and extinguished against the caps;

FIG. 26 is a side view of still another embodiment of the present invention in which the cigarette compartment pivots out of the package, and the extinguisher caps are removable/replaceable in the lid;

FIG. 27 is a side view of a cigarette package in accordance with the present invention, having no extinguisher caps, which is usable with a modified cigarette having extinguisher features as shown in FIGS. 28 and 29;

FIG. 28 is a side view of a modified cigarette having an extinguisher feature that is usable with the package of FIG. 27;

FIG. 29 is an end sectional view of a cigarette modified to have a removable extinguishing seal adhered thereto and usable with the package of FIG. 27;

FIG. 30 is a side view of the modified cigarette shown in FIG. 29 with the seal being removed and placed about the end of the extinguished cigarette;

FIG. 31 is a side view of a further variation of the cigarette package of FIG. 22 in which an ash receptacle is placed in the lid covering the fresh cigarettes;

FIG. 32 is a side view of a further variation of the cigarette package of FIG. 23 in which an ash receptacle is placed in the lid covering the butt receptacle;

FIG. 33 is a side view of a further variation of the cigarette package of FIG. 24 in which an ash receptacle is placed in the lid covering the fresh cigarettes along with the extinguisher caps;

FIG. 34 is a side view of still a further variation of the cigarette package of FIG. 24, reversing the positioning of the ash receptacle and extinguisher caps from the shown in FIG. 33;

FIG. 35 is a side view of a further variation of the cigarette package shows in FIG. 25, including an ash receptacle in the lid covering the fresh cigarettes;

FIG. 36 is a side view of a cigarette package similar to that of FIG. 35, but with the addition of non-flammable or flame resistant material in the ash receptacle;

FIG. 37 is a side view of a further variation of the embodiment of FIG. 26, but with the addition of an ash receptacle in the lid covering the extinguisher caps;

FIG. 38 is a side view of a further variation of the embodiment of FIG. 27, but with addition of an ash receptacle in the lid covering the fresh cigarettes;

FIG. 39 is a side view of a further variation of the embodiment of FIG. 27, but with the addition of an ash receptacle with flame retardant material in the lid covering the fresh cigarettes;

FIG. 40 is a side view of yet another embodiment of the present invention, wherein the lid is comprised of left and right portions which, in a closed position, overlap to seal the container;

FIG. 41 is a plan view showing a preferred placement of the extinguisher caps within the lid portions of FIG. 40;

FIG. 42 is a side view of the embodiment of FIG. 40, wherein the lid portions are in a closed position;

FIG. 43 is a plan view showing a preferred placement of the extinguisher caps within the lid portions of FIG. 40, wherein the two rows of extinguisher caps are separated by partition paper;

FIG. 44 is a top view of the package of FIG. 40, showing three rows of individual cigarette receptacles separated by partition paper;

FIG. 45 is a side view of still another embodiment of the present invention, wherein the lid is comprised of left and right portions which, in a closed position, meet to seal the container; and FIG. 46 is side view of the embodiment of FIG. 45, wherein the lid portions are in a closed position.

DETAILED DESCRIPTION OF THE PREFERRED EMBODIMENT

Figure 3:
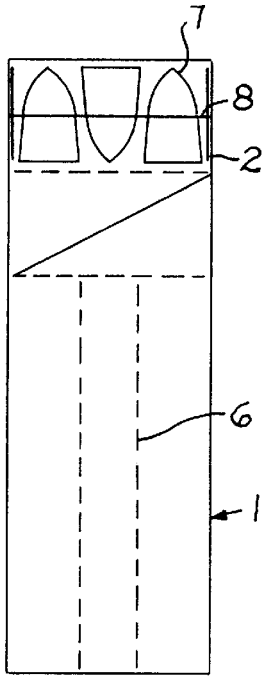
FIG. 3 is a side view of the embodiment of FIG. 1, partially in section, illustrating in dashed lines the compartments for the fresh cigarettes and the extinguisher caps built into the lid.

The following explanation makes use of FIGS. 1 through 26. FIGS. 1, 2, and 3 are, respectively, a perspective showing the front of an unopened package, a front view of the package partially in section, and a side view partially in section of a first embodiment of the present invention.

As shown in FIG. 1, the cigarette package, preferably of the hard package variety, comprises two parts: a cigarette storage container 1 and a lid 2, which serves both as the opening to the container and as a housing for the extinguisher caps 7. From FIG. 3, it may be seen that the container 1 is divided into receptacles 6 for individually storing each cigarette, and the extinguisher caps 7 can be removed from and are installed on a fixing board 8 connected to the interior of the lid 2. The package depicted in FIGS. 1–3 can be constructed of any appropriate materials such as, for example, paper, metals, or synthetic resins. Advantages to using paper would include: economy, light weight, and ease of disposal. On the other hand, use of metals or synthetic resins would enable the smoker to reuse the package repeatedly.

The structure of the package may vary from the way it is represented in FIGS. 1–3. For example, one could change the locations of the storage container 1, and the mounting of the extinguisher caps 7 could be separate from or part of the lid 2. In addition, the number of cigarettes held and their length and radius may require modifications to the receptacles 6.

FIGS. 4–6 depict a top views of various examples of the shape of the receptacles 6 in a package having enough receptacles 6 for twenty cigarettes. While each of the Figures illustrate three rows of receptacles 6, it should be understood that the number of rows can be varied as desired and appropriate. From FIG. 4, it may be seen that of the three rows of receptacles 6, two of them have pentagonal cross sections while the other has a hexagonal cross section. FIG. 5 shows a package having one row of square receptacles 6 and two rows of pentagonal ones. FIG. 6 shows a package having three rows of rounded receptacles 6. Each of the receptacles 6 of the container 1, as shown in FIGS. 4–6, stores a single cigarette. As long as this condition is adhered to, other designs are also acceptable, but FIGS. 4–6 show preferred configurations, desirable for their simplicity and efficient use of space.

FIGS. 7–9 show the extinguisher caps 7 and extinguisher cap fixing board 8 as illustrated in FIGS. 2 and 3, in respective front, side, and top views. In FIGS. 7–9, the extinguisher caps 7 are attached to fixing board a and can be inserted into position either from the top or the between through complimentary openings in the board 8. The number of extinguisher caps 7 is preferably equal to the number of cigarettes. Because the number of cigarettes and caps 7 are the same, all used cigarettes can be capped before being inserted into their respective receptacles 6. In addition, the extinguisher cap fixing board 8 can be reversed from that illustrated and removed from or reattached to the interior of the lid 2 depicted in FIG. 1. To facilitate insertion and removal of the extinguisher caps 7, the openings in the board 8, particularly when constructed of paper, may have a cut or slit 8*a* facing the centers of the holes (as best shown in FIG. 9). While the bidirectional insertion/removed capability for extinguisher caps 7, as shown, makes the most efficient use of space, a construction providing for unidirectional removal may also be used if desired.

FIGS. 10 and 11 show the extinguisher caps 7 first illustrated in FIG. 2. In FIGS. 10 and 11, an absorbent coating 10 is attached to the extinguisher caps 7, whose interiors are made from flame-resistant or flame-retardant materials. An extinguisher cap 7 should be at least long enough so that the burning tip of a cigarette can be pressed inside of it and extinguished. Greater lengths are also acceptable, but that would make it necessary to increase the size of the extinguisher cap mount 2 and the package as a whole. Keeping the caps 7 as short as possible is preferred. Any number of different materials are acceptable for use in construction of the extinguisher caps 7, as long as they are flame-resistant or flame-retardant. The preferred material has thermosetting properties and shrinks upon heating. A cap 7 made of such a material would shrink when exposed to the burning tip of a cigarette, thereby forming a tight seal around the tip. Such a seal would, in turn, cut off the supply of oxygen to the flame, helping to ensure that is thoroughly extinguished. Use of a moisture-containing substance in tandem with the highly absorbent material 10 on the inside of the extinguisher cap 7, either as a coating or a component of the material itself, further ensures extinguishing effectiveness and cooling efficiency.

When a high-absorbency coating material 10 is used, the heat from the burning end of the cigarette will cause the moisture in the high-absorbency polymer to ooze out, contributing to the extinguishing and cooling processes. Excess moisture will also be reabsorbed by such a material. In some situations, it may be desirable to coat just the part of the extinguisher cap 7 with high-absorbency material as the effectiveness will remain unhindered. Examples of materials that could be used in the construction of the extinguisher caps 7 are starches, gelatins, and proteins. These substances could also be used as odor extinguishers. The heat from the fire which they are used to extinguish also activates their odor-suppression properties.

FIGS. 12 and 13 show other ways in which the extinguisher caps 7 illustrated in FIG. 2 might be attached to the fixing board 8. Both FIGS. 12 and 13 show conically-shaped stoppers 7*a* attached to the ends of the extinguisher caps 7. These stoppers 7*a* facilitate the removal and insertion of the extinguisher caps 7 from and into the openings in the extinguisher cap fixing board 8. While FIGS. 12 and 13 show the inside of the extinguisher caps 7 having high-absorbency material coating 10 only on the parts of their interiors that are exposed to fire, it should be understood that the entire interiors may be coated as well.

FIG. 14 depicts, in perspective, the package of FIG. 1 with the lid 2 in an open position, as it would be at such times as the smoker wishes to remove a fresh cigarette or extinguish a used one. The smoker reaches in from the top to remove a cigarette 11, or inserts the burning end of a cigarette butt into an extinguisher cap 7 held by the extinguisher cap fixing board 8 attached to the interior surface of the lid 2 of the package. Alternatively, the extinguisher cap 7 may first be removed from the fixing board 8 before the cigarette butt is inserted into it and extinguished. The cap 7 and cigarette butt then can be returned to the original position of the cap 7 or inserted into the now-empty receptacle 6 from which the cigarette was originally removed. Either mode of extinguishing makes for a convenient and clean storage of the cigarette butt.

FIGS. 15–21 show still another embodiment of the present invention that differs from the embodiment in FIGS. 1–14 in that an ash receptacle unit 4 is also incorporated into the design. FIG. 15 depicts a perspective view of a package with an ash receptacle 4 attached to the upper part of the lid (or extinguisher cap housing) 2. The ash receptacle 4 itself has a lid 5, which, when opened, exposes a flame-resistant or flame-retardant interior into which a cigarette can be pressed and extinguished as described below. Ash from the cigarette may also be sealed inside of the receptacle 4 when the lid 5 is shut.

FIG. 16 and 17 show front and side sectional views of the package equipped with an ash receptacle unit 4. The ash receptacle 4 and inside of the lid 5 are coated (or otherwise enhanced) with a flame-resistant or flame-retardant substance 9. FIG. 18 shows the lid 2 to the package in an open position while the lid 5 to the ash receptacle 4 is closed. FIG. 19 shows the lid 5 to the ash receptacle 4 in an open position, but the lid 2 to the container is closed. Additionally, in order to create a tight seal between the outer surface 4*a* of the sides of the ash receptacle 4 and the inner surface 5*a* of the sides of the ash receptacle lid 5, a band of sealant material 12 has been applied to both areas as best shown in FIGS. 20 and 21. The flame-resistant or flame-retardant material 9 on the insides of the ash receptacle 4 and ash receptacle lid 5 may be applied either as a sheet, or in a fluffy form. For example, the material 9 applied to the inside of the ash receptacle 4 may be fluffy and somewhat shaggy, while that which is applied to the inside of the ash receptacle lid 5 may be smooth and sheet-like. A principal benefit of such a design in that fine ash contained in the receptacle 4 will tend to get caught in the nooks and crevices of the fluffy material, and not scatter easily. Even if the package is held with the ash receptacle lid 5 facing downwardly, it will remain relatively clean. Additionally, the sealant material 12 used to create a tight seal between the outer surface 4*a* of the sides of the ash receptacle 4 and the inner surface 5*a* of the ash receptacle lid 5 should have elastic properties such as, for example, a rubber-like substance or a flame-retardant or flame-resistant type of felt. The sealant material 12 would offer the additional advantage of preventing the ash receptacle lid 5 from being opened accidentally. The material's sealant properties and tendency to permit opening and closing could be adjusted by varying its thickness.

FIGS. 22 and 23 show respective side views of two additional embodiments, variations of the embodiment of the package illustrated in FIG. 15. In FIGS. 22 and 23, the package has a lid 2 providing access to the receptacles 6, and a second, lower lid 15 at the bottom of the package. The opening at the top of package serves as an access point through which to reactive cigarettes. The lower lid 15 serves as a housing for the extinguishing caps 7. Cigarette butts may be deposited in region 15*a* of this lower lid 15, which serves as a cigarette butt repository. An odor impermeable partition cover 17 closes the butt retention region 15*a* and additionally seals this region from the fresh cigarettes when the lower lid 15 is closed, thereby maintaining the freshness of the cigarettes. The variation shown in FIG. 23 is similar, except that the extinguisher caps 7 are mounted within the lid 2, as described before.

FIG. 24 depicts still another variations of the embodiment shown in FIG. 23. The separation of the fresh cigarettes from butts may optionally be maintained as before through the use of an odor impermeable partition 17. In this embodiment, however, the extinguishing caps 7 are mounted within the upper lid 2. For a simpler construction, use is made of an L-shaped butt-insertion-opening cover 19 attached at the bottom of package and enclosing the butts with in the package. When not in use, the cover 19 rotates into a closed position, sealed against the bottom edge of the package about the butt-insertion opening. It should be noted that, in some circumstances, the partition 17 may not be required. Additionally, the positioning of the lid 2 and the cover 19 may be reversed if desired.

FIG. 25 illustrates still another embodiment of the present invention in which the individual receptacles 6 are divided into upper and lower portions 6*a*, 6*b* by a partition 30 that is slidable or otherwise movable within the receptacle 6. A pivoting lid 2 encloses one end of the package including the fresh cigarettes 11*a* housed within the upper portions 6*a* of the receptacles 6. A cigarette 11 may be easily removed from the package, smoked, extinguished, and the butt returned at the bottom of the package and inserted into the lower portion 6*b* of the same receptacle 6 from which the cigarette was removed. The butt is pressed against the partition 30, causing the partition 30 to be moved upward in the receptacle 6, lengthening the lower portion 6*b* and allowing the butt to be retained within the package. A lower lid 32 is pivotally connected to the package and can then be closed, thereby completely sealing the cigarette butts within the package. Additionally, the partition 30 may be an extinguishing cap of the type described above, or otherwise a flame resistant material against which the butt can be extinguished and capped. The separation of the cigarette-retrieval opening 1*a* and butt-insertion opening 1*b* make it easy to retrieve fresh cigarettes 11*a* and store used ones 11*b*. It should be noted that a rounded cross-section for the receptacles 6, similar to that depicted in FIG. 6, is preferred.

FIG. 26 shows still another embodiment of the present invention depicting a package with a cigarette storage compartment 34 that, in contrast to the packages of the previous embodiments, opens in a forward direction out of the container 1. A housing 36 for the extinguisher caps 7 is located at the top of the package and has a lid 38 to access the extinguisher caps 7. Furthermore, the fixing board 8 pivots out of the housing 36, making it possible to easily insert and remove the extinguisher caps 7 into and from the fixing board 8. This design differs from the other described in that cigarettes are retrieved from the side of the container, rather than from the top. An advantage of designing the container in this manner is that it minimizes the probability that the smoker will mistake one storage compartment for another. Apart from this difference, the container is the same as described and shown in FIGS. 1 and 2.

FIG. 27 shows still another embodiment of the present invention in which the extinguisher caps and all the components thereof are not used. The absence of these parts makes for a more compact container design. It should be noted, however, that a package in accordance with FIG. 27 requires the use of extinguisher-equipped cigarettes 11*a* as depicted in forthcoming FIG. 28. An extinguisher-equipped cigarette is inserted into an empty chamber receptacle 6 after the lower lid 32 is opened. This type of operation makes it easy for the smoker to distinguish between used and unused cigarettes. It is also acceptable not to equip the container with the lower lid 32, but simply to use the original cigarette retrieval opening. It should be noted that the extinguisher caps 7 and components thereof can also be emitted from packages other than those introduced in the FIGS. 1–25, so long as the design for such containers adheres to the use of extinguisher-equipped cigarettes described here.

FIG. 28 shows an extinguishing-device-equipped cigarette 11*a* used with the package shown in FIG. 27. In FIG. 28, the extinguisher-equipped cigarette 11*a* is depicted with a cigarette filter 40 that has been modified for use with the cigarette package of FIG. 27. The filter 40 of the cigarette 11*a* has been narrowed in the center part 40*a* to enable the loading of an extinguisher bellows 42 made of paper or film into the space left around it. After taking the cigarette 11*a* out of the package, smoking and extinguishing it by other means, the bellows 42 may be pulled out in the direction of the arrow until the burnt part is fully covered, thereby forming an extinguishing chamber 44. This has the same effect as using the extinguisher cap 7 of FIG. 2. Extinguishment is completed by twisting the tip 46 of the extinguisher chamber 44 which has been pulled out. This example shows that the package without an extinguisher, as shown in FIG. 27, can be used by employing non-flammable or flame-retardant materials for the bellows 42 of the cigarettes.

FIGS. 29 and 30 show a second cigarette that can be uses with the cigarette package shown in FIG. 27, in side and cross-sectional views. In FIGS. 29 and 30, the cigarette 11*a* consists of a filter 40, a sleeve of paper 50 wrapped around the filter 40, and an external wrapper 52 (shown in dotted lines about the filter) for use as an adhesive extinguishing seal. This may be the most simply structured cigarette extinguisher. After a cigarette has been put out, the wrapper 52 is removed from about the filter 40 and wrapped around the burnt part of the cigarette 11*b,* twisting the tip 54. Because it is an adhesive seal, the wrapper 52 will not come off the cigarette butt and will work the same as the cap 7 depicted in FIG. 2.

FIGS. 31–39 correspond to FIGS. 22–27, but additionally include an ash receptacle 4. In FIG. 31, like the embodiment of FIG. 22, the package has an upper lid 2 and a lower lid 15. The lower lid 15 houses the extinguishing caps 7, the mounting board 8, and the butt retention region 15*a*. As before, the cigarette butts, once extinguished by being ground into and capped by extinguishing caps 7, are placed in the region 15*a* and can be sealed off by closing partition seal 17. In this embodiment, however, the upper lid 2 also houses an ash receptacle 4. The use of the upper and lower lids 2, 15 enables smooth removal of the cigarette, extinguishment of the cigarette, and insertion of the cigarette butt solely using the package for all of these functions. Another advantageous feature is that the ash receptacle 4 and the extinguisher caps 7 are positioned separately at the top and bottom of the package. Provided that covers or removable lids are provided on either side of the extinguisher cap housing, this permits the opposite facing caps 7 to be reached without flipping the extinguisher mounting board 8. The ash receptacle 4 may be oriented so that either the outer side or inner side can become the ash receptacle bottom 4*b* or ash receptacle lid 5. If the ash receptacle lid 5 is placed inside the lower lid 15, it will serve as a double lid, protecting against accidental opening of the ash receptacle lid 5 when the package is in motion.

The cigarette package in FIG. 32 shows the extinguisher caps 7 housed within the upper lid 2, and the ash receptacle 4 is housed within the lower lid 15 at the bottom of the package near the butt-insertion opening 1*b*. If the ash receptacle lid 5 is installed on the inner side of the ash receptacle 4, the cigarette-retrieval opening 1*a* will be at the other side of the package so that the new cigarettes will not be soiled by ash being accidentally scattered on the outside of the ash receptacle 4. All other features are identical to those shown in FIG. 31.

FIGS. 33 and 34 correspond to and depict still further variations of the embodiment of FIG. 24. In FIG. 33, the cigarette and butt storage package has a separate cigarette-retrieval opening 1*a* and butt-insertion opening 1*b,* on the top and bottom parts of the package respectively. This provides smooth segregation of retrieval of the fresh cigarettes and butt insertion and storage. The extinguisher caps 7 and ash receptacle 4 are positioned together in the package lid 2 for the cigarette-retrieval opening. A partition 17 and flap 19 are used, as before, to close the butt-insertion opening 1*b*.

In FIG. 34, the position of the extinguisher caps 7 and ash receptacle 4, as described in FIG. 3, are reversed with respect to one another. With this placement, the ash receptacle lid 5 is located on the inner side of the ash receptacle 4 so that it will function as a double lid. In this way, the ash will be protected from motion which may cause the ash receptacle lid 5 to open and scatter ash inside. All other features are identical to those shown in FIG. 33.

FIGS. 35 and 36 show further modifications to the embodiment shown in FIG. 25. As before, the package is provided with a plurality of receptacles 6 divided into two portions 6*a,* 6*b* by a movable partition 30. Fresh cigarettes 11*a* are removed from the upper portion 6*a* of the receptacle 6 following the opening of the upper lid 2. The smoker then inserts the cigarette butt (extinguished elsewhere) into the lower portion 6*b* of the receptacle 6 against the movable partition 30, moving the partition upward. The lower lid 32 is closed as before, sealing the butt within the lower portion 6*b* of the receptacle 6. In the variation shown in FIG. 35, however, the lid 2 serves as the housing for an ash receptacle 4, as described above. In this embodiment, the partitions 30 are made of an ember extinguishing material so that the butt can be extinguished during the act of moving the butt into the lower portion 6*b*. In the variation of FIG. 36, both an ash receptacle 4 and an extinguisher element 13 are housed in lid 2. In this embodiment, the smoker extinguishes the butt against the extinguishing element 13. In both the embodiments of FIG. 35 and FIG. 36, the ash receptacle 4 may be coated with an ash-retaining material, as described above. Note that it is preferred that the receptacles 6 have a circular cross-section.

The cigarette and butt storage package of FIG. 36 has an extinguisher element 13 made of non-flammable or flame-resistant materials inside the ash receptacle 4 to insure more complete extinguishing than the package of FIG. 35.

FIG. 37 is another variation of the present invention, shown in side view and corresponding to FIG. 26. It also includes an ash receptacle 4 that is part of the upper lid 38.

The side views of FIGS. 38 and 39 correspond to FIG. 27 and show further variations of the present invention. The package has an ash receptacle 4 installed in the package's upper lid 2. The cigarette and butt storage compartment in FIG. 39 also has an extinguishing element 13 comprised of non-flammable or flame-resistant materials and located inside the ash receptacle 4 to insure that the cigarette is extinguished. All other features are identical to those shown in FIG. 38.

FIG. 40 shows an example application of a package with all extinguisher caps 7 installed in the upper part of a double-leaf lid, comprised of a left lid portion 2*a* and a right lid portion 2*b* which are hinged and open and close as indicated by the arrows. The extinguisher caps 7 are installed as ten pieces in two rows, five pieces in a row, in the each of the upper lid portions 2*a,* 2*b*. Twenty extinguisher caps 7 correspond to the typical number of cigarettes in a package. FIG. 41 is a plan view that shows how the caps 7 may be installed in each of the lid portions 2*a,* 2*b*.

FIG. 42 shows the cigarette package with both lid portions 2*a,* 2*b* shut and indicates that the right lid portion 2*b* preferably overlaps the left lid portion, sealing the container 1.

FIG. 43 shows another example of storing the extinguisher caps 7 in which the extinguisher caps 7 are placed into two separate rows within each lid portion 2*a,* 2*b,* the rows being separated by partition paper 31. FIG. 44 shows an example of how to store cigarettes in the package. The cigarettes 11 are separated by pieces of partition paper 31 into three rows.

FIGS. 45 and 46 correspond to FIGS. 40 and 42, but show the package having non-overlapping left and right lid portions 2*a,* 2*b*. Closing of such a package is depicted in FIG. 46.

This invention will change the ideas that people have previously held about what a cigarette package is supposed to be. By enabling people to return their cigarette ashes and butts to the container from which they took their cigarettes in the first place, this invention will contribute to the beautification of places all around the world, including unspoiled wilderness areas, tourist areas, and urban areas.

We claim:

1. A cigarette package, comprising:

a closable compartment for enclosing fresh cigarettes;

a closable housing within said package;

a plurality of caps removably positioned within said housing and attached to said package, said caps being made from a flame resistant material for extinguishing the cigarettes when in a lit condition, and each of said caps having a shape in which a burning end of a cigarette butt may be inserted to extinguish the butt, and each of said caps being made of a material of a composition that becomes attached to and forms a tight seal around the cigarette butt thereby extinguishing its burning end.

2. The package of claim 1 including a plurality of separate, receptacles, each of said receptacles adapted to receive a fresh cigarette, and each of said receptacles adapted to receive an extinguished butt and associated cap following completion of smoking of an associated fresh cigarette.

3. The package of claim 2 in which said container has a top and bottom opening into said receptacles, said package further being provided with a first pivotable lid for covering said top opening and a second pivotable lid for covering said bottom opening, thereby permitting a smoker to retrieve a fresh cigarette from one of said receptacles through said top opening, causing said one receptacle to be empty, and inserting a capped cigarette butt into said one empty receptacle through said bottom opening.

4. The package of claim 3 including an ash receptacle housed in one of said first and second pivotable lids.

5. The package of claim 3 including an ash receptacle, said ash receptacle and said extinguishing caps both being housed in one of said first and second pivotable lids.

6. The package of claim 1 in which said caps are detachably mounted on a board within said housing, said board being attached to said package.

7. The package of claim 6 including a pivoting cover that encloses said compartment when closed.

8. The package of claim 7 in which said board is mounted within and secured to said pivoting cover.

9. The package of claim 7 in which said caps have a conical shape and are detachably fixed within openings in said board.

10. The package of claim 2 including an ash receptacle positioned within said package.

11. The package of claim 10 including a pivoting cover enclosing said compartment when in a closed position, said ash receptacle being positioned within said pivoting cover.

12. The package of claim 11 in which said caps are detachably secured to a mounting board positioned within said cover.

13. The package of claim 12 in which said ash compartment has a top member for enclosing said ash compartment independently of said pivoting cover.

14. The package of claim 1 in which said compartment is pivotably mounted within said package and pivots out of said package when opened for retrieval of a fresh cigarette.

15. The package of claim 14 in which said caps are mounted on a board secured to and portioned within a lid pivotably secured to one end of said package.

16. The package of claim 15 including an ash receptacle positioned within said lid.

17. The package of claim 2, wherein said package defines an opening into said compartment, and said closable housing comprises a pair of lids, one of said pair of lids being hinged to one side of said compartment adjacent said opening and the other of said pair of lids being hinged to an opposite side of said compartment adjacent said opening, each of said lids housing said caps, said lids being shaped and said caps being mounted in positions such that when said lids are in a closed position said caps are positioned in a plurality of juxtaposed rows within said closed lids.

18. The package of claim 17 in which said one lid overlaps and encloses said other lid when said lids are in said closed position.

* * * * *